US008522696B1

(12) United States Patent
Lee

(10) Patent No.: US 8,522,696 B1
(45) Date of Patent: Sep. 3, 2013

(54) INLAID TABLE TOP TABLE

(75) Inventor: Clifton Shao-ming Lee, Hillsborough, CA (US)

(73) Assignee: Numark Industries Company Limited, Hung Hom (CN)

( * ) Notice: Subject to any disclaimer, the term of this patent is extended or adjusted under 35 U.S.C. 154(b) by 0 days.

(21) Appl. No.: 13/199,921

(22) Filed: Sep. 13, 2011

(51) Int. Cl.
*A47B 13/00* (2006.01)

(52) U.S. Cl.
USPC ..... 108/157.18; 108/27

(58) Field of Classification Search
USPC ..... 108/90, 11, 13, 27, 157.1, 159, 159.11, 108/158.13; 248/188
See application file for complete search history.

(56) References Cited

U.S. PATENT DOCUMENTS

| | | | | | |
|---|---|---|---|---|---|
| 796,855 | A * | 8/1905 | Nurick | 108/90 |
| 826,669 | A * | 7/1906 | Kindgen | 108/90 |
| 900,247 | A * | 10/1908 | Williams | 297/440.22 |
| 1,167,716 | A * | 1/1916 | Richardson | 108/90 |
| 1,575,954 | A * | 3/1926 | Walaschek | 108/65 |
| 1,886,806 | A * | 11/1932 | Hanley | 108/90 |
| 2,729,279 | A * | 1/1956 | Axtell et al. | 297/55 |
| 2,833,609 | A * | 5/1958 | Lawless | 108/62 |
| 2,903,312 | A * | 9/1959 | Lawless | 108/62 |
| 3,029,113 | A * | 4/1962 | Draxler | 108/90 |
| 4,003,320 | A * | 1/1977 | Owens et al. | 108/158 |
| 4,048,059 | A * | 9/1977 | Evans | 108/155 |
| 4,805,541 | A * | 2/1989 | Drane et al. | 108/27 |
| 5,497,597 | A * | 3/1996 | Elzenbeck | 108/27 |
| 5,865,129 | A * | 2/1999 | Samples | 108/157.17 |
| 6,123,031 | A * | 9/2000 | Hayman-Chaffey | 108/27 |
| 6,367,392 | B2 * | 4/2002 | Moore | 108/90 |
| 6,553,921 | B2 * | 4/2003 | Liu | 108/157.15 |
| 6,883,880 | B2 * | 4/2005 | Flores | 108/157.18 |
| 7,334,531 | B2 * | 2/2008 | Rivera et al. | 108/157.15 |
| 7,341,307 | B2 * | 3/2008 | Parker et al. | 108/13 |
| 8,181,579 | B2 * | 5/2012 | Leng | 108/27 |
| 2003/0041786 | A1 * | 3/2003 | Arnell | 108/11 |

* cited by examiner

*Primary Examiner* — Jose V Chen
(74) *Attorney, Agent, or Firm* — Daniel Hopen

(57) ABSTRACT

Some embodiments of the present disclosure provide a method and apparatus for an inlaid table top table. The top table affords an aesthetically pleasing table that is not only easier to maintain but reduces packaging bulk. An inlaid table top table comprises a table top frame having a rim around an interior of the table top frame, a table top insert configured to fit within the table top frame and rest under the rim of the table top frame. A plurality of table top fasteners is configured to secure the table top insert from under the table top frame against the rim of the table top frame. A set of table legs is coupled to the table top frame, and a support ring is coupled to the set of table legs to provide additional support to the set of table legs.

13 Claims, 3 Drawing Sheets

INLAID TABLE TOP TABLE

BACKGROUND

1. Technical Field

This disclosure generally relates to securing table tops, and more particularly to a robust fastener for securing a table top against an underside table rim to provide an inlaid table top table.

2. Related Art

Conventional outdoor furniture of the type intended for use on decks and patios are very popular. Manufacturers of outdoor patio furniture are constantly called upon to offer new innovative designs that provide practical, comfortable products to the consumer. Manufacturers on one hand are interested in offering innovative and fresh designs, but are also interested in reducing manufacturing cost by simplifying and reducing the time to manufacture the outdoor patio furniture.

As the outdoor patio furniture industry has developed, a popular feature for patio tables is to provide a fresh table top design. However, providing a table top design can add substantial cost to the patio table. What is needed is a table top design that is simple to manufacture, aesthetically pleasing, and robust enough to withstand shipping the table around the world.

SUMMARY OF INVENTION

A method and apparatus for a novel inlaid table top table are disclosed which overcome shortcomings of the standard table top table and has the added benefit of simplifying packaging of the table for shipping. Accordingly, the novel inlaid table top table comprises a table top frame having a rim around an interior of the table top frame, a table top insert configured to fit within the table top frame and rest under the rim of the table top frame, a plurality of table top fasteners configured to secure the table top insert from under the table top frame against the rim of the table top frame, a set of table legs coupled to the table top frame, and a support ring coupled to the set of table legs to provide additional support to the set of table legs.

In accordance to another embodiment of the present invention, the plurality of table top fasteners each includes an angle shaped fastener having at least one mounting hole configured to receive at least one mounting screw.

In accordance to another embodiment of the present invention, the plurality of table top fasteners each includes an elastic boot configured to fit over an end of the table top fastener that contacts the table top insert.

In accordance to another aspect of the present invention, the table top frame includes threaded holes for receiving the at least one mounting screw that secures the table top fastener to the table top frame. Alternatively, the at least one mounting screw is a self-tapping screw that taps its own threads into the table top frame.

DETAILED DESCRIPTION

Figure 1:
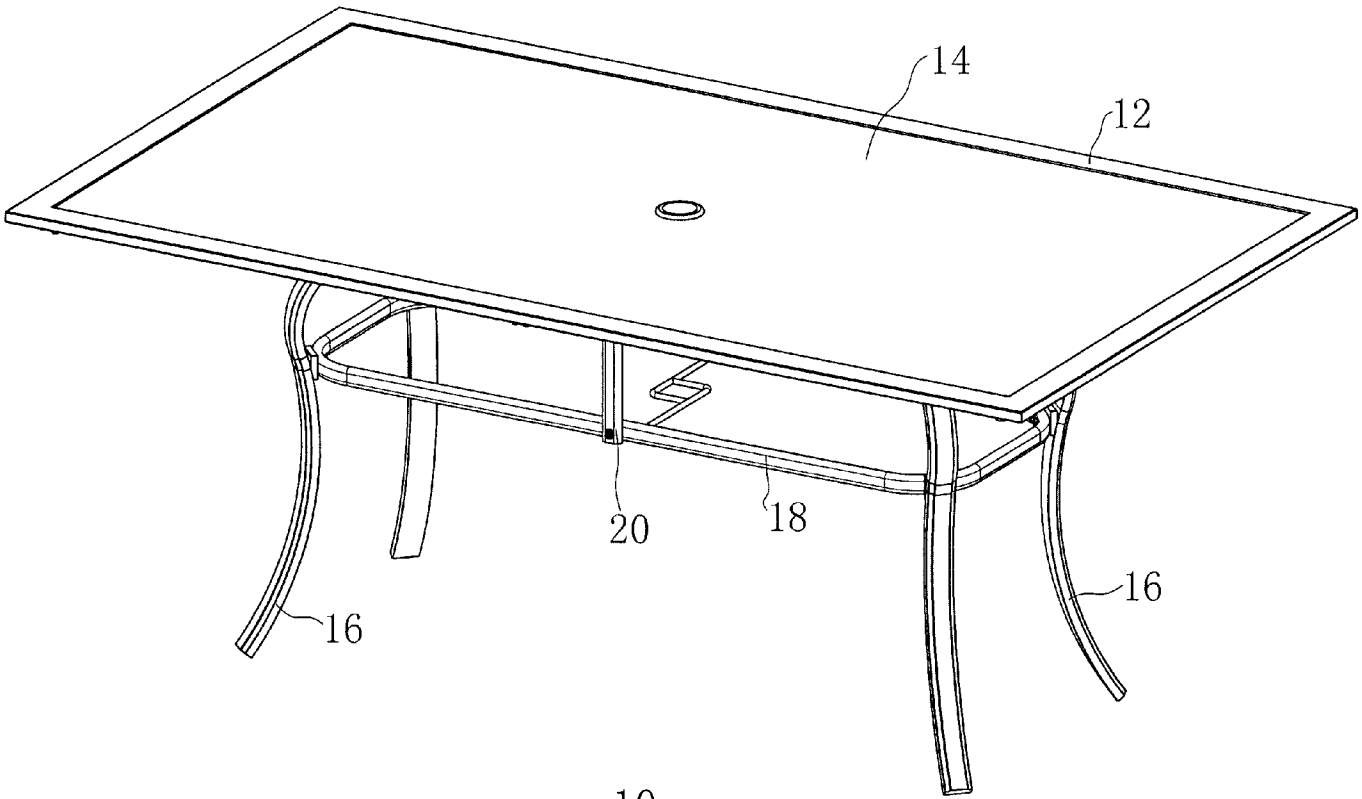
FIG. 1 illustrates an inlaid table top table in accordance with an embodiment of the present invention.

FIG. 1 illustrates an inlaid table top table 10 in accordance with an embodiment of the present invention. The inlaid table top table 10 includes a table top frame 12, a table top insert 14, a set of table legs 16, a support ring 18, and a ring support bar 20. The inlaid table top table 10 has an aesthetically pleasing appearance with the table top insert fitted within the table top frame 12. The table surface of the inlaid table top table 10 is easily cleaned without having to scrape dirt and other debris from under the table top insert as is common with previous table tops. For example, typical table top inserts are set on top of the table frame. Accordingly, the common table frames includes a lip or ledge to support the table top insert which prevents the table top insert from falling onto the ground. Since the tables may be used outdoors as in the case of patio tables, dirt and other debris from the outdoors often get trapped underneath the table top insert between the ledge of the table top frame and the table top insert. The problem is compounded when liquids are spilled or used to clean the table top as some of the liquid invariably finds their way between the ledge of the table top frame and the table top insert. Since the table top surface is commonly made of glass, the trapped debris and liquid can be seen and distracts from a clean and sanitary appearance for the table. There is no easy way to remove the trapped debris and liquids but to lift the table top insert off the ledge of the table frame to scrape and clean underneath. This is not only a dangerous procedure but is time consuming extra work for the user of the table. The table top glass is usually very large and heavy and being made of glass can break if mishandled causing a potential situation. Moreover, if the table has been sitting outside for any length of time, there may be moss, algae or other growth embedded on the glass and ledge of the table frame which makes cleaning even more a burden. The present embodiment of the inlaid table top table solves the problems of the prior table by moving the ledge or rim to the top side of the table frame.

Figure 2A:
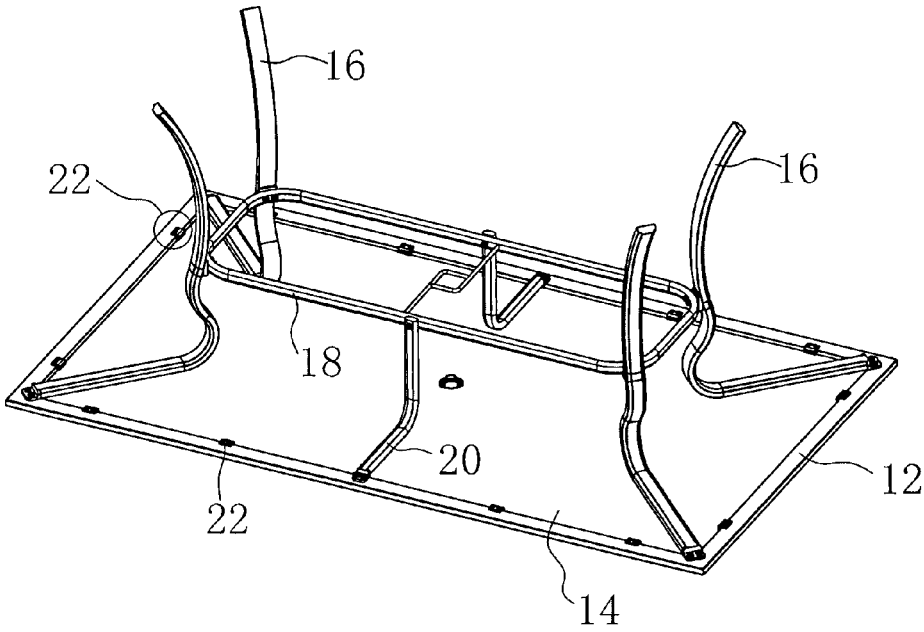
FIG. 2A illustrates an underside view of the inlaid table top table in accordance with an embodiment of the present invention.

FIG. 2A illustrates an underside view of the inlaid table top table 10. From the underside, the table top frame 12 has the table top insert 14 set within the table top frame 12. The set of legs 16 are attached to each corner of the table frame 12. The support ring 18 is attached to the set of legs 16 to provide additional support. Similarly, the ring support bars 20 are attached to the support ring 20 to further provide extra stability to the inlaid table top table 10. Since the table top insert 14 is set within the table top frame 12, a plurality of table top fasteners 22 secures the table top insert 14 adjacent a rim 32 (shown in FIG. 3) that protrudes from the interior perimeter of the table top frame 12. The table top fasteners 22 are angled and are attached to the table top frame 12.

Figure 2B:
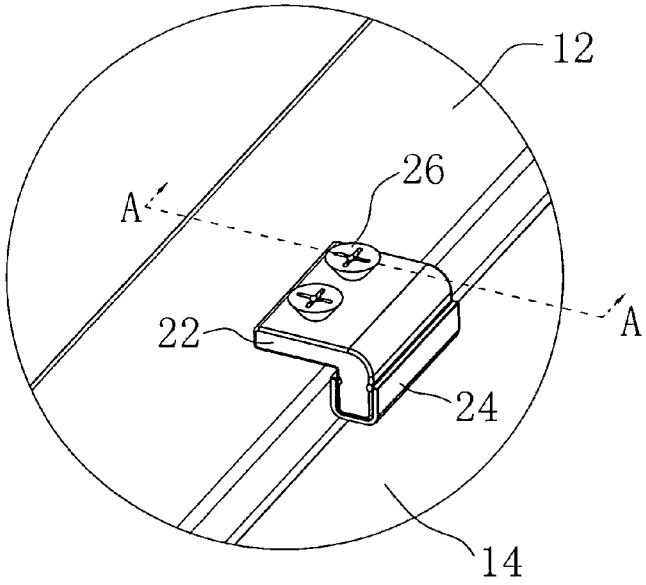
FIG. 2B illustrates a detailed view of the table top fastener, table top frame, and table top insert.

FIG. 2B illustrates a blow up view of the table top fastener 22, the table top frame 12, and the table top insert 14 depicted in FIG. 2A. The table top fastener 22 is angled and has an elastic boot 24 that fits over an end of the table top fastener 22. The elastic boot 24 contacts the table top insert 14 and provides a soft contact surface against the table top insert 14. In accordance with an embodiment of the present invention, the elastic boot is made of plastic and the table top insert 14 is made of glass. The table top insert 14 can have a decorative design etched in the glass to provide more aesthetic appeal. Two screws 26 are used in the present embodiment to attach and secure the table top fastener 22 to the table top frame 12. The elastic boot 24 provides some flexibility to the table top fastener 22 so that when the screws 26 are tightened, the table top fastener 22 is snug against the table top insert 14.

Figure 3:
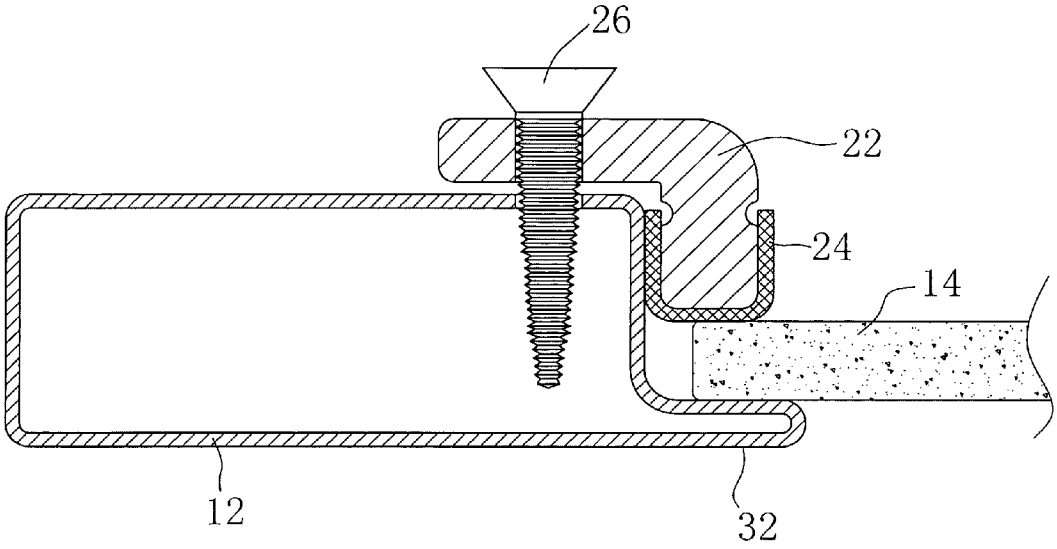
FIG. 3 illustrates an exemplary cut-out view of the table top fastener taken along line A-A of FIG. 2B.

FIG. 3 illustrates a cross-section of the table top fastener 22 of FIG. 2B taken along line A-A. The table top frame 12 has a rim 32 that is pressed against table top insert 14 as the table top fastener 22 is secured against the table top frame 12 by tightening the screw 26. The table top frame has threads to enable the screw 26 to securely attach the table top fastener 22 to the table top frame 12. Alternatively, the screw 26 is a self tapping screw which enables the screw 26 to self-tap into the table top frame 12 and tightly attach the table top fastener to the table top frame 12. The elastic boot 24 provides a flexible surface against the table top insert 14 to ensure a snug fit and non-marring surface.

Another advantage of the inlaid table top table is the ability to have the table top insert assembled with the table top frame when the table is shipped. This eliminates extra assembly by the end user and simplifies packaging. With the table top insert assembled with the table top frame, the table top insert is protected from breakage and greatly simplifies and reduces packaging material used to pad the table top insert. Additional padding material used to pad the table top insert is substantially reduced since the table top insert is integrated with the table top frame. The overall size of the shipping package is also reduced which saves transportation costs for shipping the inlaid table top table. The end user would need only to attach the legs and ring supports.

The present novel inlaid table top table is susceptible to minor variations and modifications that may be introduced without departing from the inventive concept. For example, instead of a rim around the interior perimeter of the table top frame 12, multiple tangs protruding from or attached to the table top frame can be used. The table top fastener can be mated with the tangs to provide the necessary support for the table top insert 14. More or less screws or other fastener devices can be used for the table top fastener 22.

It is further appreciated that designation of furniture as fitting into categories such as chairs, lounges, and other separate and distinct varieties may be inadequate. For example, patio furniture as opposed to furniture designs may show no clear delineation separating the two categories. Accordingly, a patio table design may be used as a table for indoor use.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Moreover, the above disclosure is not intended to limit the present invention. The scope of the present invention is defined by the claims.

I claim:

1. An inlaid table top table comprising:

a table top frame having a rim extending inwardly from a perimeter defined by the table top frame, wherein the table top frame and the rim comprise a one piece unitary structure;

a table top insert configured to fit within the table top frame and entirely rest under the rim of the table top frame;

a plurality of table top fasteners positioned adjacent the rim to secure the table top insert against the rim of the table top frame wherein each table top fastener is secured to the table top frame from underneath the table top frame and each table top fastener is interchangeable with another table top fastener;

a set of table legs coupled to the table top frame; and a support ring coupled to the set of table legs to provide additional support to the set of table legs.

2. The inlaid table top table of claim 1 wherein the plurality of table top fasteners each includes an angle shaped fastener having at least one mounting hole configured to receive at least one mounting screw.

3. The inlaid table top table of claim 2, wherein the plurality of table top fasteners each includes an elastic boot configured to fit over an end of the table top fastener that contacts the table top insert.

4. The inlaid table top table of claim 3, wherein the table top frame includes threaded holes for receiving the at least one mounting screw that secures the table top fastener to the table top frame.

5. The inlaid table top table of claim 4, wherein the at least one mounting screw secures the table top fastener against the table top insert and the rim of the table top frame.

6. The inlaid table top table of claim 5, wherein each table top fastener includes two mounting screws to secure the table top fastener to the table top frame.

7. The inlaid table top table of claim 1, wherein the table top insert is glass.

8. The inlaid table top table of claim 7, wherein the table top insert includes a decorative design.

9. The inlaid table top table claim 8, wherein the table top insert includes an etched design.

10. A method of manufacturing an inlaid table top table comprising the steps:

forming a one piece unitary table top frame having a rim extending inwardly from a perimeter defined by the table top frame;

placing a table top insert entirely under the rim of the table top frame; and attaching a plurality of table top fasteners to the table top frame along the rim of the table top frame using a plurality of screws to secure the table top insert adjacent the rim of the table top frame wherein each table top fastener is interchangeable with another table top fastener.

11. The method of claim 10 further comprising the step of attaching a set of legs to the table top frame.

12. The method of claim 11 further comprising the step of attaching a center ring to the set of legs to provide additional support for the set of legs.

13. The method of claim 10, wherein the step of attaching the plurality of table top fasteners includes screwing the plurality of screws into the table top frame to secure the table top fasteners adjacent the table top insert.

* * * * *